US007124455B2

(12) United States Patent
Demarco et al.

(10) Patent No.: US 7,124,455 B2
(45) Date of Patent: Oct. 24, 2006

(54) BED SHEET SET WITH DIFFERENT THERMAL PROPERTIES

(76) Inventors: Deanne M. Demarco, 15054 SE. 44th St., Bellevue, WA (US) 98006; Richard J. Demarco, 15054 SE. 44th St., Bellevue, WA (US) 98006

( * ) Notice: Subject to any disclaimer, the term of this patent is extended or adjusted under 35 U.S.C. 154(b) by 0 days.

(21) Appl. No.: 11/059,077

(22) Filed: Feb. 15, 2005

(65) Prior Publication Data

US 2005/0268399 A1 Dec. 8, 2005

Related U.S. Application Data

(60) Provisional application No. 60/577,136, filed on Jun. 4, 2004.

(51) Int. Cl.
*A47G 9/02* (2006.01)

(52) U.S. Cl. ..... 5/486; 5/482

(58) Field of Classification Search ..... 5/486, 5/482, 497, 495; D6/602, 603
See application file for complete search history.

(56) References Cited

U.S. PATENT DOCUMENTS

| | | | | |
|---|---|---|---|---|
| 3,072,776 A | | 1/1963 | Quenneville | 219/46 |
| 3,331,088 A | | 7/1967 | Marquette | 5/334 |
| 3,508,285 A | | 4/1970 | Marquette | 5/334 |
| 3,530,516 A | * | 9/1970 | Marquette | 5/486 |
| 4,005,499 A | * | 2/1977 | Klein | 5/485 |
| 5,007,125 A | * | 4/1991 | Owenby | 5/486 |
| 5,287,573 A | * | 2/1994 | Ritacco | 5/486 |
| 5,708,995 A | | 1/1998 | Wu et al. | 5/486 |
| 6,643,872 B1 | | 11/2003 | Buswell | 5/486 |

* cited by examiner

*Primary Examiner*—Alexander Grosz
(74) *Attorney, Agent, or Firm*—Dean A. Craine

(57) ABSTRACT

The bed sheet set with two or more bed sections with different thermal properties for occupants who share the bed and desire to sleep with bedding having different thermal properties. The invention includes a top bed sheet and a bottom bed sheet divided into two adjacent bed sections made of thin and thick cotton, respectively. In the first embodiment, the two bed sections are longitudinally aligned and sewn together along the sheets' longitudinal center axis. The top sheet includes a decorative inside surface and a transversely aligned decorative band, which provides an attractive edge when the top edge of the top bed sheet is partially folded over. The top and bottom bed sheets are made of cotton, polyester or nylon that can be frequently laundered and changed like normal cotton bed sheets.

7 Claims, 5 Drawing Sheets

BED SHEET SET WITH DIFFERENT THERMAL PROPERTIES

This utility patent application is based on the provisional patent application (Ser. No. 60/577,136) filed on Jun. 4, 2004.

BACKGROUND OF THE INVENTION

1. Field of the Invention

This invention relates to bed clothing and, more particularly, to bed sheets designed for individuals sharing a bed who desire to sleep between bed sheets having different thermal insulation properties.

2. Description of the Related Art

It is well known that bed sheets are laundered more often than a bed's outer blankets and bed cover. One reason for this is that the bed sheets are in direct contact with the occupants of the bed and need to be laundered on a weekly basis. Another reason is that the outer blankets and bed cover are generally made of thicker, decorative fabric that often requires special washing and drying procedures.

The top and bottom sheets used on a bed typically have matching or complementary decorative colors and patterns printed on their inside surfaces. It is presumed that the practice of matching the color or patterns on inside surfaces of the two sheets developed because the two surfaces are sometimes seen together, such as when the upper edge of the top sheet is folded downward over the upper edge of the top blanket when the bed is made or when the occupant enters or exits the bed.

Couples that sleep in the same bed, of course, share the sheets and blankets. It is well known, that individuals may desire bedding with different thermal insulation properties. Heretofore, blankets having sections with different thermal characteristics have been invented, (See U.S. Pat. Nos. 5,007,125 and 5,708,995). None of these patents, however, disclose or suggest a set of bed sheets with different thermal properties with matching or complimentary inside surfaces.

SUMMARY OF THE INVENTION

It is an object of the present invention to provide a set of top and bottom bed sheets that have sections with different thermal and insulative properties.

It is another object of the present invention to provide such a set of bed sheets that can be laundered like standard cotton bed sheets and are aesthetically pleasing.

These and other objects of the present invention are met by a set of bed sheets disclosed herein that includes a top sheet divided into two adjacent, bed sections made of materials that have different thermal properties. In the first embodiment, the two bed sections are longitudinally aligned and sewn together along the sheet's center axis. The top sheet includes a decorative inside surface that matches or is visually compatible with the decorative inside surface formed or printed on the bottom sheet. The bottom sheet in the set may be made of a single material having uniform thickness and thermal properties or it may be made of two bed sections made of two different materials having different thermal properties like the top sheet. In the preferred embodiment, a decorative band is sewn along the top edge of the top sheet, which creates a uniform, aesthetic edge when the top sheet is folded over the top blanket on the bed.

In the preferred embodiment, the one bed section on the top and bottom sheets are made of lightweight cotton similar to a cotton material commonly used today on standard bed sheets while the other bed section is made of heavier, thicker cotton or flannel similar to a light blanket. The two bed sections may be easily cleaned and dried in a home's standard washer and dryer.

DESCRIPTION OF THE PREFERRED EMBODIMENT(S)

Figure 1:
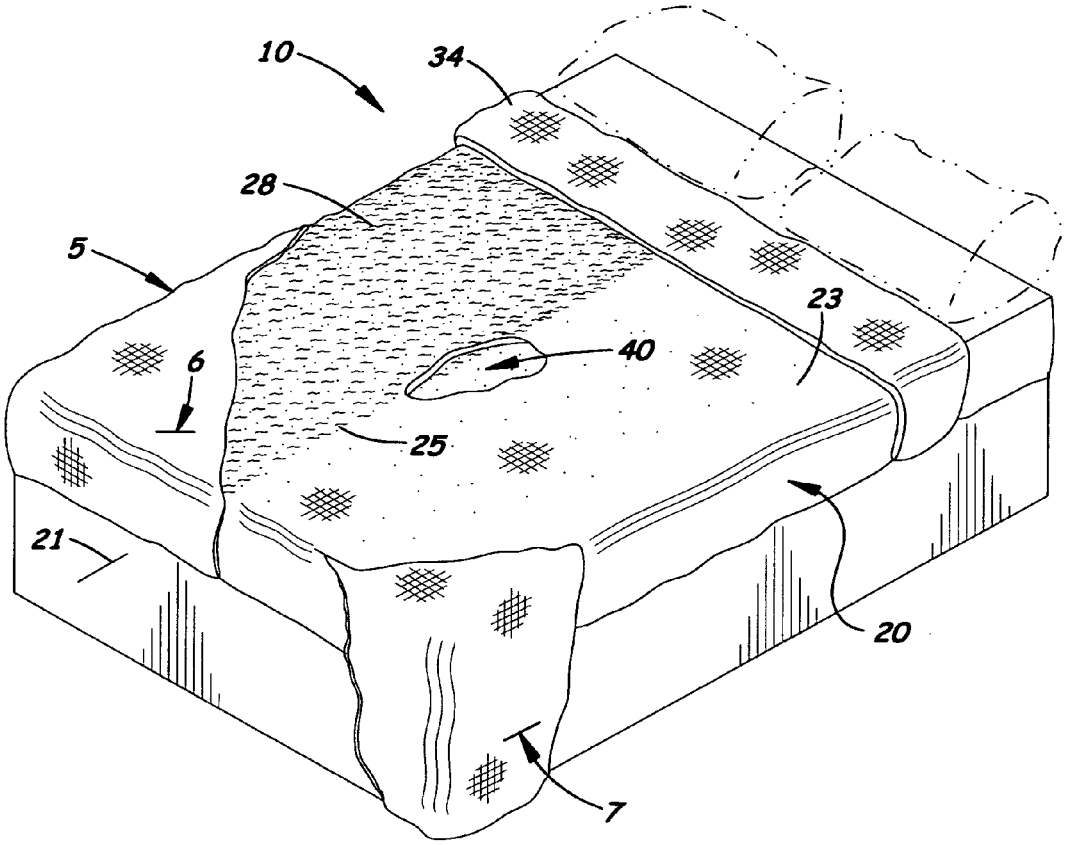
FIG. 1 is a perspective view of a bed with the bed sheet set placed thereon.

Referring to the FIG. 1, a bed 5 is shown with a bed sheet set 10 described herein design to satisfy the needs of two individuals sleeping in the bed 5 who desire bedding with different thermal insulating properties. When sleeping, the bed sheet set 10 allows two occupants in the bed 5 to share bedding without forcing one occupant to accept the other occupant's thermal insulating bedding choices. Top blankets 6 and bed cover 7 can be added or removed from the bed 5 to easily meet each occupant's preferences.

Figure 2:
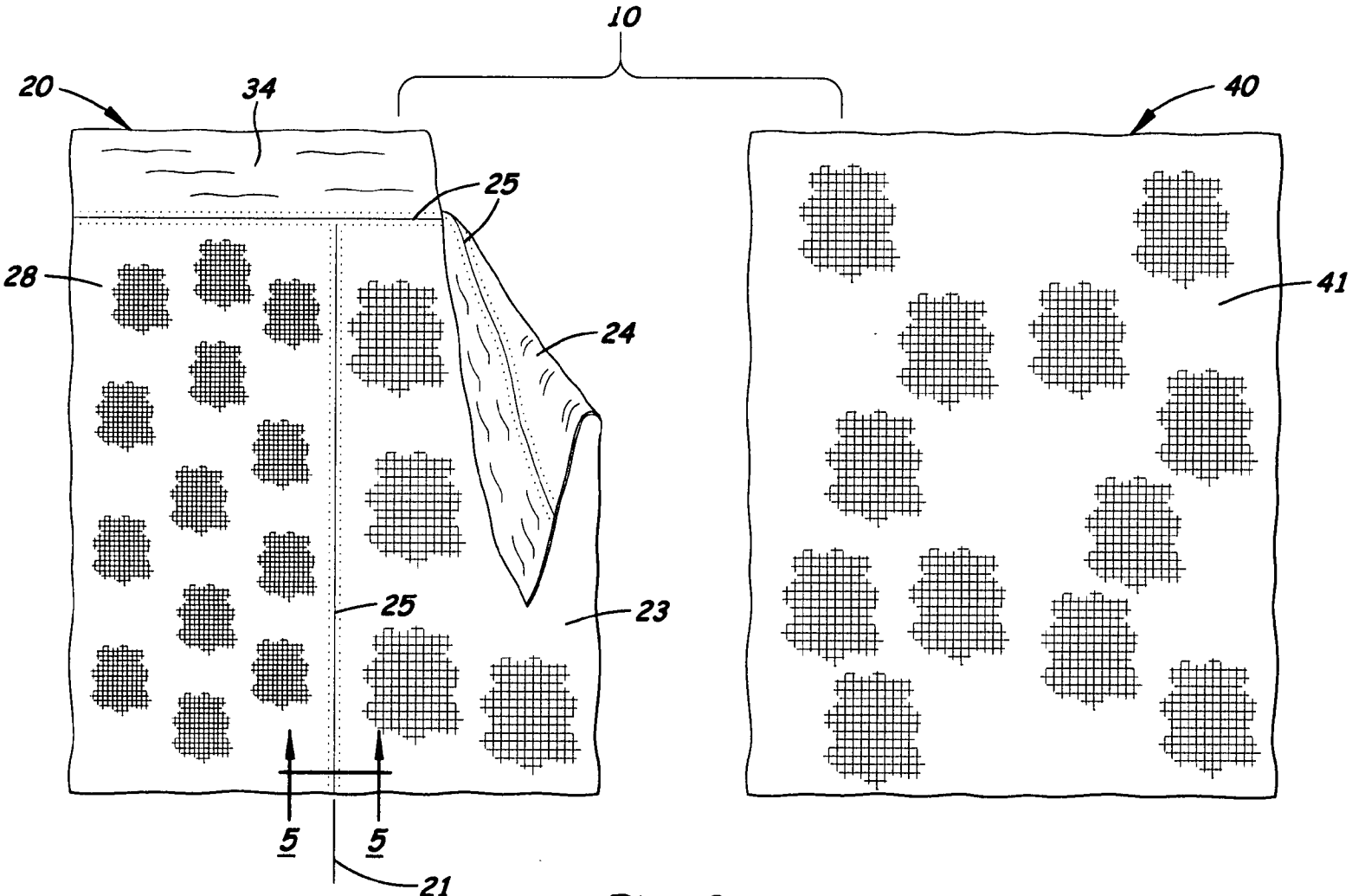
FIG. 2 is a top plan view of the first embodiment of the bed sheet set.
Figure 3:
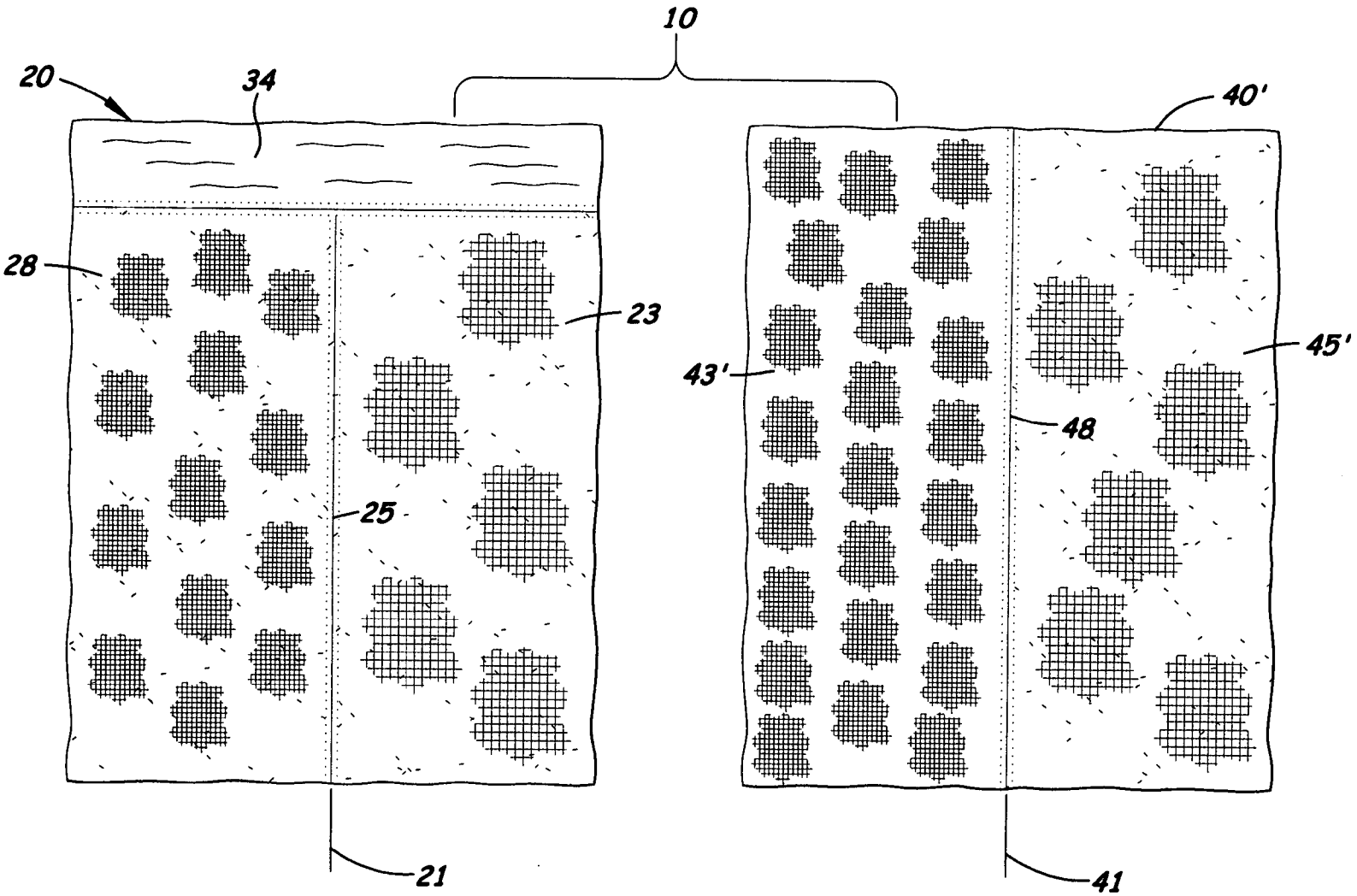
FIG. 3 is a top plan view of a second embodiment of the bed sheet set.

As shown in FIG. 2, the bed sheet set 10 includes a top sheet 20 and a bottom sheet 40. The top sheet 20 is divided into two longitudinally aligned first and second bed sections 23, 28. The first bed section 23 is made of thin, lightweight cotton while the second bed section 28 is made of thicker, heavy cotton, such as flannel. The first and second bed sections 23, 28 are longitudinally aligned on opposite sides of the top sheet 20 and sewn together at a seam 25 located along the sheet's center axis 21. In the first embodiment shown in FIG. 2, the bottom bed sheet 40 is made of the same thin, lightweight cotton material used in the first bed section 23. In a second embodiment shown in FIG. 3, the bottom bed sheet 40' is made of two adjacent, longitudinally aligned bed sections 43', 45', similar to the two sections 23, 28, respectively, used on the top sheet 20 shown in FIG. 2.

As seen in the figures, the top sheet is generally rectangular in shape, and is comprised of a generally rectangular, wide continuous band 34, that has a width of approximately 12 inches, as measured in the longitudinal direction of the bed on which it is to be used, the band being sewn to the upper edges of the bed sheet sections that have different thermal properties.

Figure 4:
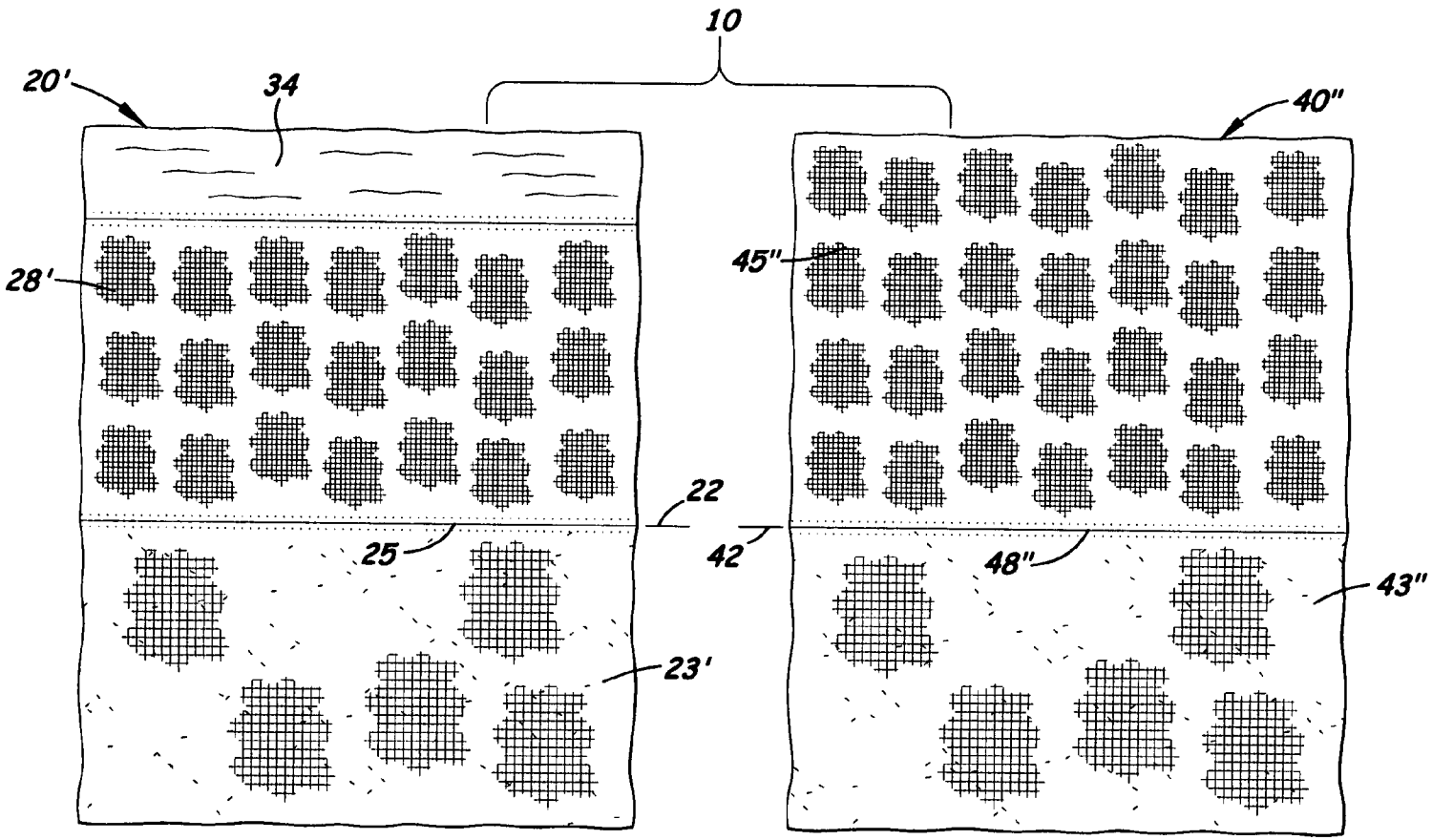
FIG. 4 is a top plan view of a third embodiment of the bed sheet set.

FIG. 4 shows a third embodiment of the invention with the top sheet 20' divided into two transversely aligned bed sections 23', 28' made of thin and thick cotton, respectively. The two bed sections 23', 28' are sewn together along the sheet's transverse axis 22. The thin section 23' is located over the occupant's feet while the thicker section 28' is located over the occupant's shoulders. During use, the top sheet 20 may be selectively rotated on the bed 5 so that the thin section 23' covers the user's shoulders while the thicker section 28' covers the occupant's feet. The top sheet 20' is shown being used with a bottom sheet 40" which also includes two transversely aligned thin and thicker bed sections 43", 45", respectively also connected together along a seam 48" aligned over top sheets' center axis 42. Like the top sheet 20', the bottom sheet 40" may be rotated so that bed sections 43", 45" are positioned against different areas on the occupant.

In every embodiment, the top and bottom sheets 20, 40 have an inside surface 24, 41, respectively, that includes a decorative design or color that matches. Also in every embodiment, a wide decorative band 34 is sewn along the upper transverse edge of the top sheet 20 which creates an aesthetic edge.

Figure 5:
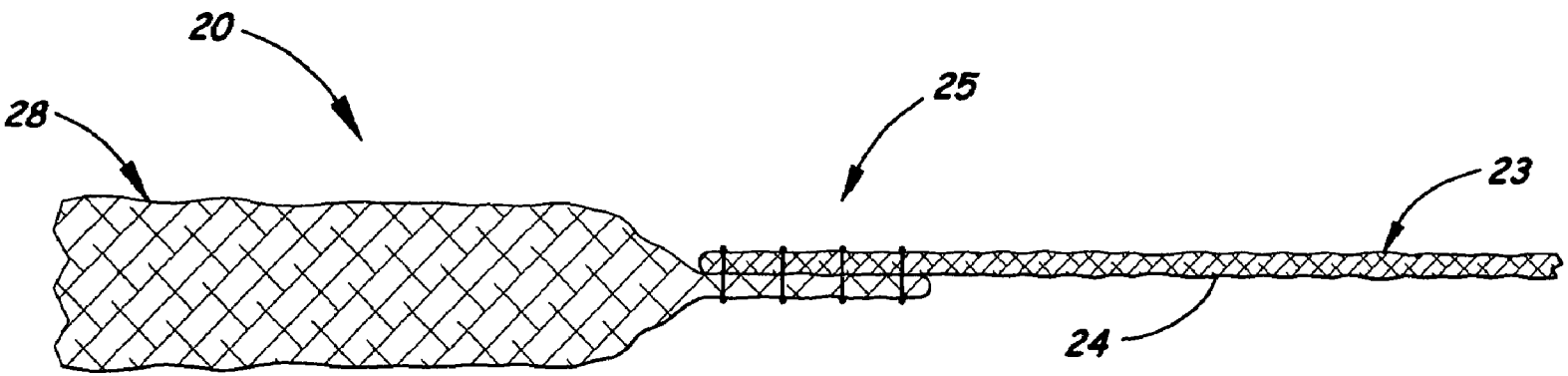
FIG. 5 is a sectional side elevational view of the top bed sheet taken along line 5—5 in FIG. 2.

As shown in FIG. 5, the adjacent edges of the sections 23 and 28 on the top sheet 20 overlap and are sewn together to form a seam 25. The seams 48" on the bottom sheets 40' and 40" respectively are made the same way.

In FIGS. 1–4, the sheets 20, 20',40, 40', 40" are designed for a double bed and measures approximately 84×101 inches with the top band 34 measuring approximately 84×12 inches. In the first embodiment shown in FIGS. 1 and 2, each side section 23, 28 is approximately 41–½×89 inches. The center seam 25 is approximately 1 inch wide. It should be understood, the top and bottom sheets 20, 20', 40, 40', 40" may be designed for use on a Queen-size bed which measures approximately 92

As stated above, the two sections 23, 28 on the top and bottom sheets 20, 20', 40, 40', 40" are made of thin and thick cotton respectively. It should be understood, however, that the two sections 23, 28 maybe made of wool, silk or nylon having different insulting properties.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

We claim:

1. A bed sheet set, comprising;

a. a generally rectangular top bed sheet made of at least two bed sheet sections made of material with different thermal properties, said two bed sheet sections being longitudinally aligned and sewn together along a longitudinally aligned central seam, each said bed sheet section including an inside surface and an upper edge;

b. a wide, generally rectangular continuous band sewn to said upper edges of said bed sheet sections thereby forming a visible uniform edge when said top bed sheet is extended and folded over a top blanket placed over said top bed sheet, the width of said band being approximately 12 inches; and, c. a bottom bed sheet including an inside surface that is visually compatible with said inside surfaces of said two bed sheet sections used on said top bed sheet.

2. The bed sheet set, as recited in claim 1, wherein said bed sheet sections on said top bed sheet are substantially equal in size and longitudinally aligned on said top bed sheet.

3. The bed sheet set, as recited in claim 1, wherein one said bed sheet section on said top bed sheet is made of thin cotton and the other said bed sheet section on said top bed sheet is made of cotton flannel.

4. The bed sheet set, as recited in claim 1, wherein said bottom bed sheet includes at least two longitudinally aligned bed sheet sections, with said bed sheet sections on said bottom bed sheet having different thermal properties.

5. The bed sheet set, as recited in claim 4, wherein said two bed sheet sections on said bottom bed sheet are connected together along a longitudinally aligned center seam.

6. The bed sheet set, as recited in claim 4, wherein said top bed sheet sections and said bottom bed sheet sections are substantially equal in size.

7. The bed sheet set, as recited in claim 4, wherein one said bed sheet section on said bottom bed sheet is made of thin cotton and other said bed sheet section on said bottom bed sheet is made of cotton flannel.

* * * * *